US005865204A

United States Patent [19]

Bracy

[11] Patent Number: 5,865,204

[45] Date of Patent: Feb. 2, 1999

[54] WALKING CANE ASSEMBLY HAVING PIVOTING SAFETY TIP

[75] Inventor: Delrey Bracy, Everett, Wash.

[73] Assignee: Beyond Challenges LLC, Everett, Wash.

[21] Appl. No.: 24,082

[22] Filed: Feb. 17, 1998

[51] Int. Cl.[6] ..... A45B 9/04

[52] U.S. Cl. ..... 135/82; 135/84

[58] Field of Search ..... 135/68, 70, 77, 135/82, 84, 86

[56] References Cited

U.S. PATENT DOCUMENTS

| | | | |
|---|---|---|---|
| 1,287,613 | 4/1918 | Hipwood . | |
| 2,140,541 | 12/1938 | Moore . | |
| 2,403,632 | 7/1946 | Brown . | |
| 2,419,105 | 4/1947 | Allan . | |
| 3,040,757 | 6/1962 | Smith . | |
| 3,467,117 | 9/1969 | Lucibello . | |
| 4,440,186 | 4/1984 | Lottner . | |
| 4,881,564 | 11/1989 | Fetterman . | |
| 4,947,882 | 8/1990 | Lavasseur | 135/84 |
| 5,088,513 | 2/1992 | Ostermeyer . | |
| 5,307,828 | 5/1994 | Gardner et al. . | |

*Primary Examiner*—Lanna Mai
*Attorney, Agent, or Firm*—Todd N. Hathaway

[57] ABSTRACT

A pivoting tip assembly for a walking cane, which accommodates both tilting and rotation of the shaft of the cane while the base of the tip remains in stationary engagement with the floor. A disk member is mounted to the lower end of the shaft for rotation about the long axis thereof, and has a rounded outer edge which engages the inner surface of a socket formed in the rubber tip. The disk member is sized to have a sliding fit with the inside surface of the socket, so that the disk is able to tilt within the socket as the shaft of the cane tilts back and forth. The opening at the top of the socket is sized larger than the shaft, so that the shaft can tilt through a predetermined range of angular movement before striking the lip of the cup; at the limit of travel, the shaft comes into contact with the resilient material of the cup, which provides a yielding stop to the tilting motion. A radial skirt is mounted to the shaft above the tip assembly, which permits the operator to retrieve the cane without having to bend over, by stepping on the tip of the cane and then sliding a foot under the upper end of the shaft so as to pivot the cane to a position in which the handle is within reach.

20 Claims, 2 Drawing Sheets

WALKING CANE ASSEMBLY HAVING PIVOTING SAFETY TIP

BACKGROUND a. Field of the Invention

The present invention relates generally to walking canes, and more particularly, to a walking cane having a tip assembly which is able to tilt and rotate relative to the shaft during use so as to reduce the possibility of a slip or fall.

b. Background Art

Most walking canes are provided with a rubber tip in an effort to provide stable engagement between the cane and a floor or other underlying support surface. In practice, however, it has been found that conventional rubber tips possess grave limitations which often result in severe injury to the user.

For example, with most rubber tips the shaft of the cane needs to be held in substantially vertical alignment, so that the contact patch on the bottom of the tip will be able to flatly engage the floor surface. Unfortunately, people frequently hold a cane at an outward angle from their bodies in an effort to steady themselves, so that the shaft extends at an angle to the floor rather than straight up and down. This causes the rubber tip to contact the floor at an angle, with only an edge of the tip engaging the floor surface. Consequently, when the person's weight bears on the cane at this angle, the tip tends to slide out, often causing the person to fall. Naturally, this problem is even more acute if the surface of the is slick or damp.

The problem of the tip slipping out becomes even more problematic when the person rotates the shaft of the cane with the natural motion of their hand/wrist as they walk or move about, since this twists the tip against the floor and tends to break it free from frictional engagement therewith.

Some prior attempts have been made at providing a cane tip which accommodates tilting of the shaft. Examples of these include devices which are shown in the following U.S. Pat. Nos.: 5,307,828 (Gardner et al.); 4,947,882 (Lavasseur); 4,881,564 (Fetterman); 2,419,105 (Allan); and 1,298,713 (Hipwood).

Most of these earlier devices have been too complex and cumbersome to be practical. For example, the Hipwood patent shows a device which provides a tilting and rotating action, but this uses a complex pneumatic mechanism and ball bearing arrangement.

Similarly, the Lavasseur reference shows a cumbersome assembly which employs a ball-and-socket mechanism with a large, domed, elastomeric ring which permits a degree of tilting motion; this device can also be tilted up by stepping on the edge of the base assembly when the cane is lying on the ground (see FIG. 4), but this requires the person to lift their foot a significant distance above the floor and requires a great deal of dexterity.

The Gardner patent shows another complex arrangement, which in this case uses a central plug which is mounted to the cane shaft and connected to a large rectangular pad by a rubber cord. In addition to being cumbersome, the range of motion which this device permits is limited by the elasticity of the rubber cord.

The Fetterman device employs an internal structure in which a soft, cushioning material deforms to accommodate irregularities in the surface or changes in angular orientation. Apart from the complexity and expense which are inherent in this design, deformation of the walls and base of the tip make it difficult for this device to maintain a flat contact surface with the floor under heavy loading. Moreover, the amount of tilting which is permitted by the device depends on the flexibility of the material, and the elastomeric loading of the material at high angular displacements tends to interfere with its ability to maintain stable engagement with the floor.

The Allan device, in turn, has a domed "hat member" which fits within the base of a cane tip having a more or less conventional shape, with a a second washer member on the end of the wooden shaft which rests atop the domed member to provide a rocking action. The upper washer has a downwardly-projecting saw tooth edge, so that this can be removed from the rubber tip and used on icy surfaces. Although this design has the advantage of simplicity, the rubber tip is still friction-mounted on the end of the shaft in essentially the same way as conventional tips, which prevents the shaft of the cane from twisting independently of the tip. Furthermore, like virtually all of the other devices described above, the resistance of the elastomeric member increases steadily with increasing angular displacement of the cane shaft, so that at greater angles the increased elastomeric loading tends to force the tip back towards alignment with the shaft and away from the horizontal plane of the floor. This creates a dangerous situation, since a momentary interruption of the downward pressure on the cane or a slippery surface may allow the tip to spring back towards alignment with the shaft, causing a loss of grip with the floor.

Another problem with existing types of canes is that these are often difficult for the user to pick up in the event that they are accidentally dropped. Since most cane users have impaired physical motions, they frequently lack the physical dexterity to bend over and reach the handle of a cane which is lying on the ground or floor. As was noted above, the device disclosed in the Lavasseur patent does little to alleviate this situation, since it is difficult to use and does not raise the cane handle high enough for this to be reached without having to bend over.

Accordingly, there exists a need for an anti-slip cane tip which is capable of remaining in perpendicular engagement with a floor or other support surface while the shaft of the cane is tilted through a large range of angular displacement. Moreover, there is a need for such a tip which will permit the shaft of the cane to be rotated independently of the tip, so that the user can twist the cane without fear of the tip losing its grip against the floor. Still further, there is a need for such a tip which will accommodate significant angular displacement of the shaft without causing increasing elastic loading of a resilient member which would tend to force the tip away from the plane of the floor. Still further, there is a need for such a tip which is simple and inexpensive in construction, and which employs a conventionally-shaped external rubber tip member so that this can be replaced easily and at minimal cost. Still further, there is a need for a cane having such a tip which can be picked up without the user having to bend over, in the event that the cane is accidentally dropped on the floor or other horizontal surface.

SUMMARY OF THE INVENTION

The present invention has solved the problems cited above, and is a compact tip assembly which accommodates both tilting motion and rotation of the shaft while the tip remains stationary on and aligned perpendicular to the floor surface. A comparatively large disk member is mounted to the end of the cane shaft for rotation thereon, and has a rounded outer edge which engages the inner surface of the cup area inside a rubber tip. The opening at the top of the cup is sized larger than the diameter of the shaft, so that the shaft can tilt back and forth through a predetermined range of the angular movement without striking the rubber lip of the cup. As this is done, the large disk member tilts inside the bottom of the cup so as to direct the weight downwardly through the base portion thereof and into the floor.

The disk member is sized to have a sliding friction fit inside the rubber tip member, which offers a substantially constant resistance to the tilting motion throughout most of the range of angular travel. At the limit of travel, the shaft comes into contact with the lip of the rubber cup, providing a yielding stop the motion. The rotational mounting of the disk member to the end of the shaft permits the shaft of the cane to be rotated freely without twisting the rubber tip against the floor surface.

In a preferred embodiment, the present invention provides a cane having a pivoting tip assembly, comprising: (a) a shaft member having a long axis and upper and lower ends, (b) a tip member having a socket portion in which the lower end of the shaft member is received and a base portion for resting on an underlying support surface, and (c) a disk member interconnecting the shaft member and the tip member, the disk member having (i) a center portion which is mounted to the lower end of the shaft member so as to permit the disk member to rotate freely about the long axis of the shaft member, so that the base portion of the tip member remains in a stationary engagement with the underlying support surface as the shaft member of the cane is twisted back and forth, and (ii) an outer edge portion which is in sliding engagement with an interior surface of the socket portion of the tip member so as to permit the disk member to tilt freely within the socket portion, so that the base portion of the socket member remains in stationary engagement with the underlying support surface as the shaft member of the cane is tilted from side to side.

The socket portion of the tip member may comprise a generally cylindrical interior wall portion having the interior surface which is in sliding engagement with the disk member, and an interior floor portion having a generally flat upper surface which is in vertical weight-bearing engagement with at least a portion of the disk member.

The outer edge of the disk member may comprise a generally circular rim portion which is in substantially continuous engagement with the interior surface all around the wall portion of the socket portion. The disk member may further comprise a downwardly convex lower bottom surface portion which forms a rocker bearing surface against the flat upper surface of the floor portion of the socket member, so a to facilitate tilting of the disk member on the floor in response to side-to-side tilting of the shaft member. The outer edge portion of the disk member may further comprise a perimeter portion formed of a low-friction material for bearing against the interior wall surface of the socket portion in sliding engagement therewith.

The wall portion of the tip member may be formed of resiliently yielding material, such as semi-rigid rubber material, and may extend upwardly to an upper opening through which the shaft member of the cane extends into the tip member. The upper opening may have a diameter which is sized larger than the diameter of the shaft member where this passes through the opening, so as to permit the shaft member to tilt through a predetermined angular range of motion relative to the tip member before coming into contact with the wall portion. The wall portion may be configured to resiliently and cushioningly arrest tilting motion of the shaft member as the shaft member comes into contact therewith at a predetermined limit of the angular range of motion.

The interior surface of the wall portion of the tip member may have a frustoconical upward taper, from a base diameter which is approximately equal to a diameter of the disk member, to an upper diameter at the opening which is substantially smaller than the diameter of the disk member, so that the wall portion retains the disk member against removal from the tip member. The taper preferably extends upwardly from the floor portion of the tip member at an angle which corresponds generally to an arc through which the edge portion on a first side of the disk member travels upwardly as the shaft member is tilted through the angular range of motion, while the edge portion on an opposite side of the disk member pivots adjacent a junction between the floor portion and the wall portion of the tip member.

The cane may further comprise a pivot connection for mounting the center portion of the disk member to the lower end of the shaft member for rotation about the long axis of the shaft member. The pivot connection may comprise a plug portion on the lower end of the shaft member, and a screw member which extends upwardly through the center portion of the disk member into the plate portion generally coaxially with the long axis of the shaft member, so that a shank of the screw member forms a pivot axis for rotation of the disk member and a head of the screw member secures the disk member to the lower end of the shaft.

The walking cane may further comprise a skirt member which is mounted to the shaft a spaced distance above the tip, and which extends radially from the shaft so a to have a diameter which is greater by a predetermined amount than an outside diameter of the base of the tip. The amount by which the diameter of the skirt is greater than the base diameter of the tip is preferably sufficient that when the cane is lying in a generally horizontal position, depressing of the tip member against the underlying support surface pivots the shaft about the skirt and raises the upper end of the cane above the support surface by a distance which is sufficient for the toe of a shoe to be received between the upper end of the shaft and the underlying surface, and then slid towards the lower end of the cane so as to pivot the handle upwardly to a position in which it can be reached without having to bend over.

The present invention also provides a pivoting tip assembly which can be mounted to an existing cane.

DETAILED DESCRIPTION a. Overview

Figure 1:
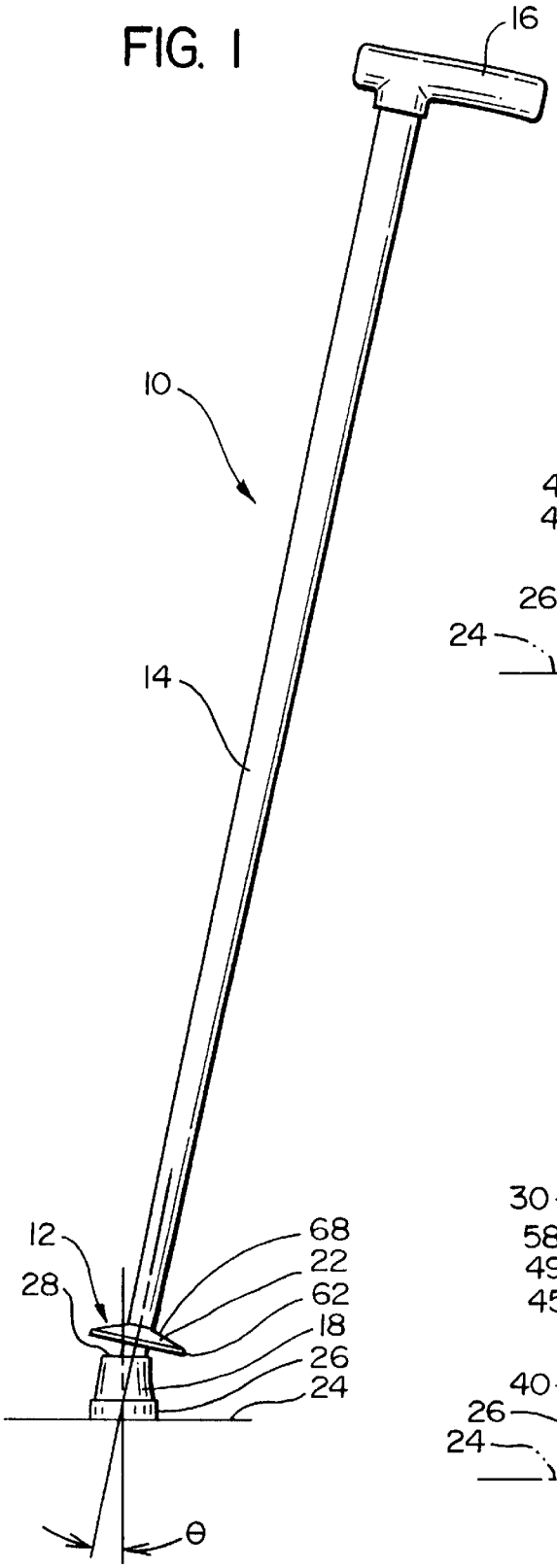
FIG. 1 is an elevational view of a walking cane in accordance with the present invention, this showing the shaft of the cane tilted an angle while the tip assembly maintains the rubber tip thereof perpendicular to the horizontal surface of the floor.

FIG. 1 shows a cane 10 having a tip assembly 12 in accordance with the present invention. The upper part of the cane is generally conventional in its overall configuration, comprising a tapered shaft 14 which is preferably formed of tubular aluminum material (although wood, fiberglass, plastic, or any other structurally suitable material may be used), and a somewhat T-shaped handle 16 (although again, other shaft/handle configurations may employed).

The tip assembly 12 comprises three principal components: the rubber tip member 18, the internal pivot mechanism 20 (see FIGS. 2–3), and the upper skirt member 22. As can be seen in FIG. 1, the tip assembly 12 allows the shaft 13 of the cane to be tilted from vertical to an angle θ, while the tip remains perpendicular to the floor surface 24 with its foot portion 26 resting flatly thereon.

As can also be seen in FIG. 1, the diameter of the opening 28 into the cup area of the tip is sized somewhat larger than the diameter of the tubular shaft of the cane in this area, so that the shaft can tilt from perpendicular to a predetermined angle θ without contacting or compressing the elastomeric material of the rubber tip member. This eliminates the possibility of developing any sideways elastomeric loads which would tend to dislodge the tip from the floor.

The skirt member 22 keeps water/debris from entering through the top opening of the tip member (in a manner somewhat similar to an umbrella), and also allows the user to pick up the cane without having to stoop over. As will be described in greater detail below with reference to FIGS. 4–5, this is performed by stepping on the tip assembly when the cane is lying on the floor, and then sliding the other foot under the shaft so as to pivot this upwardly to a position at which the person is able to reach the handle without bending over.

b. Pivot Mechanism

Figure 2:
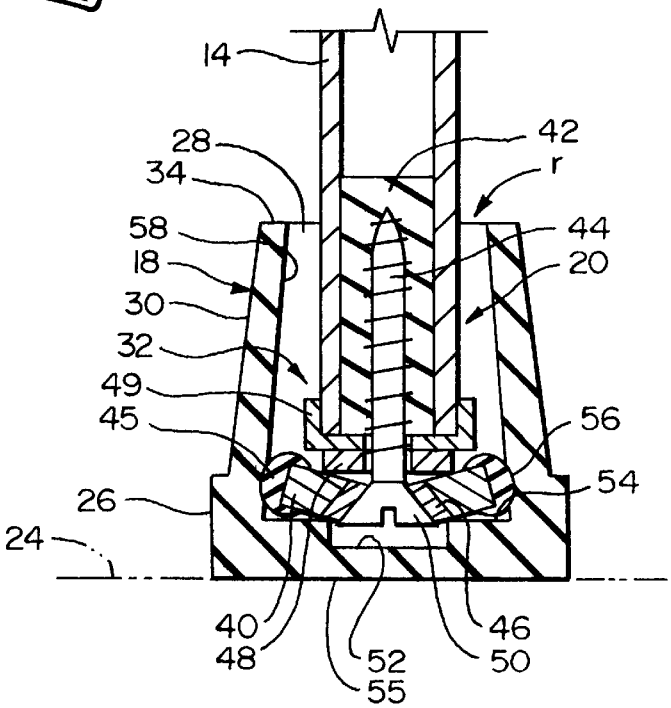
FIG. 2 is an enlarged cross-sectional view of the tip assembly of the cane of FIG. 1, showing the assembly in an initial position in which the shaft extends vertically, perpendicular to the floor surface.

As can be seen in FIG. 2, the rubber tip member 18 has an external shape which is generally similar to that of conventional rubber cane tips, in that this has a substantially flat foot portion 26 for engaging the floor surface 24, and an upwardly-tapering, frustoconical wall 30 which defines the interior cup area 32.

As was noted above, the upper lip 34 of the wall defines an opening 28 having a diameter which is significantly larger than the diameter than the shaft 14 where it passes through this opening, forming a predetermined radial gap "r" between the two members.

From the opening, the shaft 14 extends downwardly into the cup area 32, with a rotating disk member 40 being mounted on the lower end of the shaft. A hard rubber plug 42 in the lower end of the tubular shaft 14 receives a countersunk screw 44 which extends in generally co-axial alignment with the shaft, so that the head of the screw secures the disk to the end of the shaft and the shank of the screw serves as a pivot axis for the disk (in the case of wooden-shaft canes, the screw may simply be driven into the lower end of the shaft itself, rather than into a separate insert).

Figure 3:
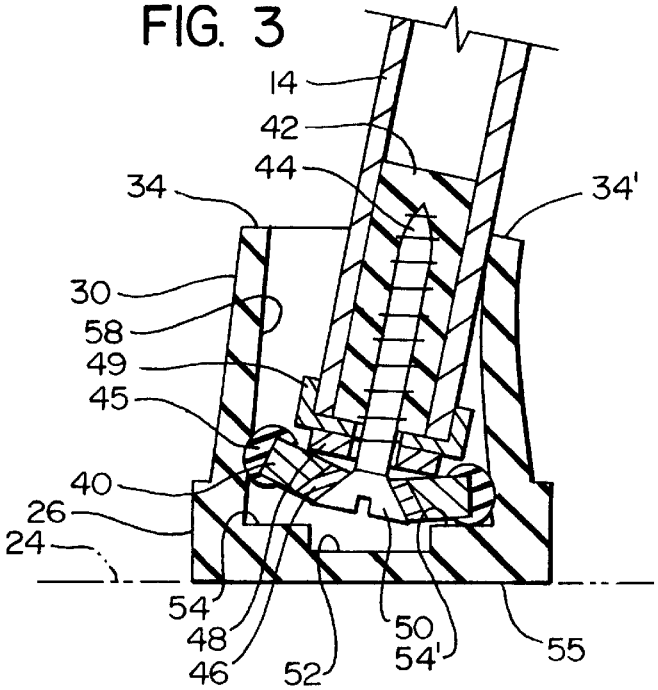
FIG. 3 is a cross-sectional view similar to FIG. 2, showing the assembly with the shaft of the cane tilted over to an angle while the tip assembly maintains its vertical orientation relative to the floor.

The disk member 40, which may suitably be formed of steel or other metal, has a parabolically curved or dished configuration, as shown in FIGS. 2–3, so that the bottom of the disk member forms a convex rocker surface. A plastic edging 45 is mounted around the perimeter of disk member 40, and is preferably formed of a suitable material having low-friction, wear-resistant characteristics, with nylon or delrin being eminently suitable materials for this purpose; also, as can be seen in FIG. 2, the outer edge 56 of the plastic edging is preferably smoothly radiused in vertical cross-section. This configuration (i.e., a low-friction edging mounted around the edge of the disk) has the advantage of combining smooth action with durability, but it will be understood that in some embodiments the entire disk may be made of the low-friction material or the low-friction edging may be dispensed with in the interest of economy.

The outside diameter of the disk member 40 (including the edging) is selected so that this extends outwardly beyond the end of the shaft and engages the frustoconically-tapered inner surface 58 of the wall of the tip member. The relative diameters of the disk and cavity are such that the rubber material of the wall is slightly compressed where this contacts the disk, so as to form a firm yet sliding friction fit between the two members.

A frustoconical bushing 46 is installed between the shaft of the screw and the pivot disk, so as to enable the latter to rotate freely about the vertical axis of the assembly. A small flat washer 48 is installed between the dished upper surface of the disk member 40 and the lower end of the shaft, so as to form an enhanced bearing surface for rotation of the shaft and also to improve the weight distribution and stability characteristics of the assembly. The upper surface of washer 48 bears against the lower surface of a cup-shaped shield member 49, which its mounted over the lower end of the shaft 14 so as to protect the aluminum tube and rubber plug 42 from wear.

On the underside of the disk member, in turn, the head 50 of screw 44 is received in a shallow recess 52 which is formed in the top of the foot portion of the rubber tip member. Thus, when the assembly is in vertical alignment as shown in FIG. 2, the perimeter of the rotating disk member 40 rests evenly on an annular shoulder 54 around the recess 52, with the substantially planar bottom surface 55 of the tip member being pressed downwardly in flat, weight bearing engagement against the floor 24.

As the shaft 14 tilts away from the vertical angle, the disk member 40 tilts or "rocks" on the annular shoulder 54, as can be seen in FIG. 3, so that one edge rides up the inside surface of wall 58, while the opposite edge pivots adjacent the junction between the wall and the floor of the socket. Because the inward taper of frustoconical wall 58 corresponds roughly to an arc of constant radius from the opposite lower corner of the cup area, the contact pressure exerted by the edge of the disk member against wall 58 remains relatively constant throughout its range of motion, thereby providing a substantially constant amount of frictional sliding resistance. The low-friction, radiused edge of the disk ensures a smooth sliding motion across the inner surface of the cup, and also enhances wear characteristics so as to ensure long service life. Furthermore, lubricant may be applied to the inside of the cup area to adjust the sliding resistance of the disk member against the rubber material, if desired.

Throughout full the range of angular motion, in whichever direction this occurs around the axis of the assembly, the edge along the underside of the parabolically curved disk member remains in constant, weight-bearing contact with the annular shoulder 54 at the bottom of the cup area. For example, at the angular displacement which is shown in FIG. 3, one side of the disk is lifted away from the weight bearing shoulder, while on the opposite side the edge of the disk maintains contact with the shoulder in area 54' so as to transfer weight vertically from the shaft into the foot portion of the tip member. The motion of the disk member 56 as the cane shaft 14 tilts in various directions is therefore somewhat analogous to the action of a saucer wobbling on a table top, with the weight being directed downwardly through whichever portion of the edge is in contact with the "table", while the underlying contact surface 55 on the bottom of the tip member remains in constant, flat engagement with the floor surface 24.

As was noted above, the radial gap around the shaft 14 at the opening into the cup area enables the shaft to tilt freely throughout most of its range of motion without causing compression any elastomeric member. However, as the limit of travel is reached, the shaft comes into contact with the upper lip 34 of wall 58, as indicated at area 34'. This causes the elastomeric material of the lip to deform outwardly in this area until the resistance is sufficient to arrest the motion of the shaft, thereby providing a gradual, yielding "stop" at the limit of the range of motion, rather than an abrupt halt.

The hard rubber insert 42 in the end of the shaft member 14 enhances the resilient cushioning action of the tip assembly, and also permits a limited degree of tilting motion of the disk relative to the shaft member itself. Furthermore, this configuration eliminates the possibility of the disk working loose from the end of the shaft, as might be the case if a hard, inflexible metal/wood mounting was to be used at this point.

c. Skirt Member

Figure 4:
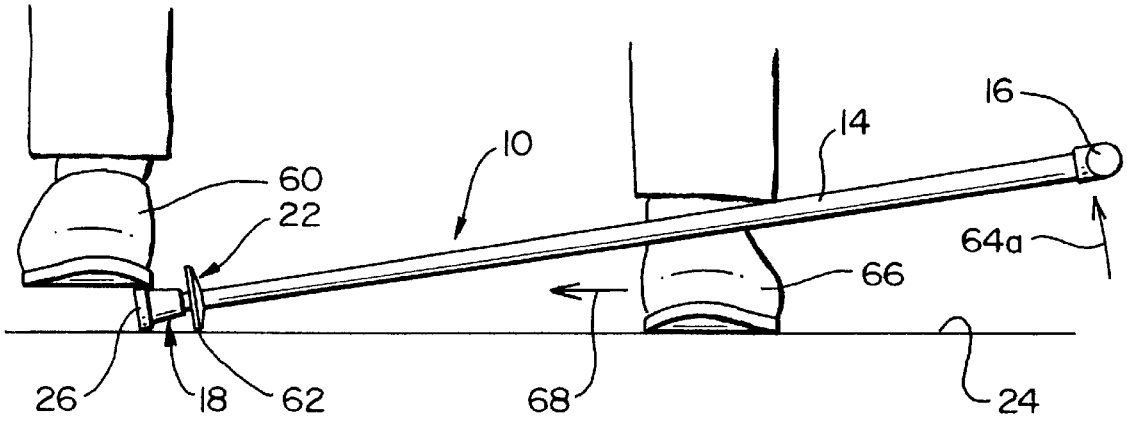
FIG. 4 is an elevational view showing the cane of FIG. 1 in a first position in which this has been dropped on a floor so that the shaft thereof extends in a generally horizontal direction, illustrating the manner in which the skirt portion of the assembly enables the user to raise the upper end of the shaft so as to be able to slide a foot thereunder.
Figure 5:
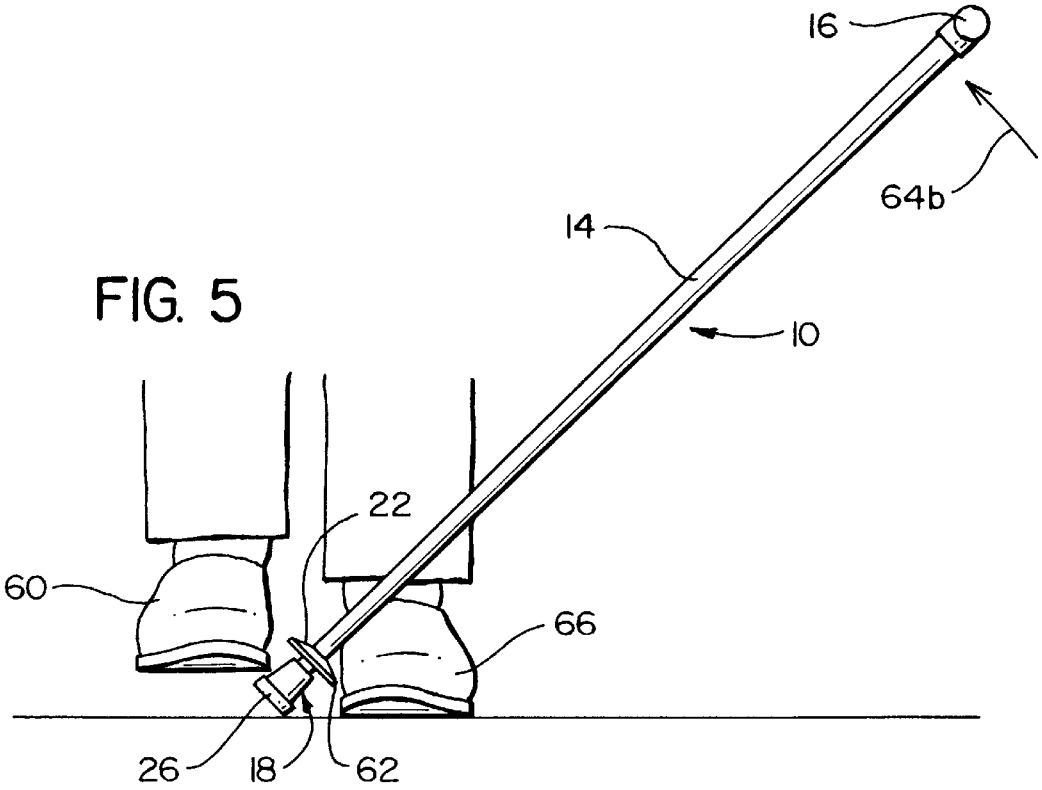
FIG. 5 is an elevational view similar to FIG. 4, showing the manner in which continued sliding motion of the person's foot under the shaft in a direction towards the tip assembly raises the shaft of the cane to an angle at which the handle can be reached without the person having to bend over.

FIGS. 4–5 illustrate the manner in which the skirt member 22 aids the user in retrieving the cane after this has fallen to the floor.

As can be seen in FIG. 4, the first step in picking up the cane is to simply place a foot 60 against the side of the tip member 18, so as to press downwardly on the footing portion 26 thereof. The outwardly extending edge 62 of the skirt member bears against the floor surface and provides a fulcrum about which the shaft 14 of the cane pivots as the tip member is pressed downwardly, raising the upper end of the shaft and the handle 16; being that the skirt member is positioned relatively close to the tip member (e.g., 2–3 inches above the base), at a spaced distance from the lengthwise center point of the shaft, pressing the tip member downwardly a relatively short distance causes the other end of the shaft to pivot upwardly by a much greater distance, as indicated by arrow 64. This provides sufficient clearance beneath the shaft 14 to allow the person's second foot 66 to be inserted between this and the floor so that the shaft rides up on the instep of the foot, with the person's legs being spread apart at about shoulder's width as shown in FIG. 4.

From this position the person then slides the second foot 66 towards the first, in the direction indicated by arrow 68 in FIG. 4. Because of the height difference between the sole of the first foot 60 and the instep of the second foot 66 (on top of which the shaft is resting), moving the feet together causes the shaft to pivot upwardly, lifting the edge of the skirt member 22 off of the floor and moving the handle 16 in an upward direction as indicated by arrow **64*b* in FIG. 5. When the two feet are finally brought together to the position which is shown in FIG. 5, the shaft 14 extends upwardly at an angle of approximately 45°–60°, so that the handle 16** is positioned close to wars level and can be reached without having to bend over. As was noted above, this is an important advantage, being that elderly or disabled people commonly have insufficient body movement available to stoop over by any significant distance.

In addition to assisting the user in picking up the cane as described above, the skirt member 22 also serves the important function of keeping rain water and dirt/debris from entering the cup area 32 of the rubber tip member, thereby preventing these contaminants from interfering with the function of the device or causing damage/corrosion to the components. Accordingly, and as can also be seen in FIG. 1, the diameter of the skirt member is preferably sized such that the outer edge 62 of the skirt extends radially well beyond lip 34 so as to deflect materials from falling downwardly into the cup area; also, the upper surface 68 of the skirt member is preferably sloped downwardly and outwardly around the shaft in order to facilitate deflection of the rain water and debris.

The skirt member 22 may be fabricated of any suitable material, with rigid, abrasion-resistant plastic being eminently suitable for this purpose.

d. Exemplary Dimensions

Exemplary dimensions for a cane assembly in accordance with the present invention are listed below. It will be understood, however, that these dimensions are provided for purposes of illustration only, and that these figures and characteristics may be modified as desired for various embodiments of the present invention:

| | |
|---|---|
| Overall Shaft Length: | 36.6" var. |
| Shaft Diameter at Tip: | ⅜" |
| Diameter of Tip Opening: | ¾" |
| Diameter of Tip Face: | 1¼" |
| Height of Rubber Tip: | 1½" |
| Diameter of Rotating Disk Member: | 13/16" |
| Thickness of Disk Member: | 1/16" |
| Tip Material: | Rubber (carbon black) with nylon plastic washer |
| Disk Material: | Steel (hardened) |
| Bushing Material: | Brass |
| Height of Skirt Member above bottom of Tip: | 2⅛" |

It is to be recognized that various alterations, modifications, and/or additions may be introduced into the constructions and arrangements of parts described above without departing from the spirit or ambit of the present invention as defined by the appended claims.

What is claimed is:

1. A walking cane having a pivoting tip assembly, comprising:

a shaft member having a long axis and upper and lower ends;

a tip member having a socket portion in which said lower end of said shaft member is received and a base portion for resting on an underlying support surface; and a disk member interconnecting said shaft member and said tip member, said disk member having:

a center portion which is mounted to said lower end of said shaft member so as to permit said disk member to rotate freely about said long axis of said shaft member, so that said base portion of said tip member remains in stationary engagement with said underlying support surface as said shaft member of said cane is twisted back and forth; and an outer edge portion which is in sliding engagement with an interior surface of said socket portion of said tip member so as to permit said disk member to tilt freely within said socket portion, so that said base portion of said socket member remains in stationary engagement with said underlying support surface as said shaft member of said cane is tilted from side to side.

2. The walking cane of claim 1, wherein said socket portion of said tip member comprises:

a generally cylindrical interior wall portion having said interior surface which is in sliding engagement with said disk member; and an interior floor portion having a generally flat upper surface which is in vertical weight-bearing engagement with at least a portion of said disk member.

3. The walking cane of claim 2, wherein said outer edge portion of said disk member comprises:

a generally circular rim portion which is in substantially continuous engagement with said interior surface all around said cylindrical wall portion of said socket portion.

4. The walking cane of claim 2, wherein said disk member further comprises:

a downwardly convex lower bottom surface portion which forms a rocker bearing surface against said flat upper surface of said floor portion of said socket member, so as to facilitate tilting of said disk member on said floor portion in response to side-to-side tilting of said shaft member.

5. The walking cane of claim 2, wherein said outer edge portion of said disk member comprises:

a perimeter portion formed of low-friction material for bearing against said interior wall surface of said socket portion in sliding engagement therewith.

6. The walking cane of claim 2, wherein said wall portion of said tip member is formed of an resiliently yielding material.

7. The walking cane of claim 6, wherein said resiliently yielding material is a semi-rigid rubber material.

8. The walking cane of claim 6, wherein said wall portion of said socket portion of said tip member extends upwardly to an upper opening of said socket portion through which said shaft member of said cane extends into said tip member.

9. The walking cane of claim 8, wherein said upper opening of said socket portion has a diameter which is sized larger than a diameter of said shaft member where said shaft member passes therethrough, so as to permit said shaft member to tilt through a predetermined angular range of motion relative to said tip member before coming into contact with said wall portion at said upper opening of said socket portion.

10. The walking cane of claim 9, wherein said upper edge of said wall portion is configured to resiliently and cushioningly arrest tilting motion of said shaft member as said shaft member comes into contact therewith at a predetermined limit of said angular range of motion.

11. The walking cane of claim 9, wherein said interior surface of said wall portion of said tip member has a frustoconical upward taper, from a base diameter which is approximately equal to a diameter of said disk member to an upper diameter at said opening which is substantially smaller than said diameter of said disk member, so that said wall portion retains said disk member against removal from said socket portion of said tip member.

12. The walking cane of claim 11, wherein said frustoconical upward taper extends upwardly from said floor portion of said tip member at an angle which corresponds generally to an arc through which said outer edge portion on a first side of said disk member travels upwardly as said shaft member is tilted through said angular range of motion while said outer edge portion on an opposite side of said disk member bears against said floor portion of said socket member pivots adjacent a junction between said floor portion and said wall portion of said tip member.

13. The walking cane of claim 2, further comprising:

a pivot connection for mounting said center portion of said disk member to said lower end of said shaft member for rotation about said long axis of said shaft member.

14. The walking cane of claim 13, wherein said pivot connection comprises:

a plug portion on said lower end of said shaft member; and a screw member which extends upwardly through said center portion of said disk member into said plug portion generally coaxially with said long axis of said shaft member, so that a shank portion of said screw member forms a pivot axis for rotation of said disk member and a head portion of said screw member secures said disk member to said lower end of said shaft member.

15. The walking cane of claim 1, further comprising:

a skirt member which is mounted to said shaft member a spaced distance above said tip member, and which extends radially from said shaft member so as to have a diameter which is greater by a predetermined amount than an outside diameter of said tip member at said base portion thereof.

16. The walking cane of claim 15, wherein said predetermined amount by which said diameter of said skirt member is greater than said outside diameter of said tip member is sufficient that when said cane is lying in a generally horizontal position on said underlying support surface, depressing said tip member against said support surface pivots said shaft member about said skirt member and raises said upper end of said cane member above said support surface by a distance which is sufficient for a toe portion of a shoe of a predetermined height to be slid between said upper end of said shaft member and said underlying support surface.

17. A pivoting tip assembly mountable to a walking cane having a long axis and upper and lower ends, said tip assembly comprising:

a tip member having a socket portion for receiving said lower end of said shaft member and a base portion for resting on an underlying support surface; and a disk member for interconnecting said shaft member of said cane and said tip member, said disk member having:

a center portion which is mountable to said lower end of said shaft member so as to permit said disk member to rotate freely about said long axis of said shaft member, so that said base portion of said tip member remains in stationary engagement with said underlying support surface as said shaft member of said cane is twisted back and forth; and an outer edge portion which is in sliding engagement with an interior surface of said socket portion of said tip member so as to permit said disk member to tilt freely within said socket portion, so that said base portion of said socket member remains in stationary engagement with said underlying support surface as said shaft member of said cane is tilted from side to side.

18. The pivoting tip assembly of claim 17, wherein said socket portion of said tip member comprises:

a generally cylindrical interior wall portion having said interior surface which is in substantially continuous sliding engagement with a generally circular rim portion of said disk member all around said cylindrical wall portion; and an interior floor portion having a generally flat upper surface which is in vertical weight-bearing engagement with at least a portion of said disk member.

19. The pivoting tip assembly of claim 18, wherein said wall portion of said socket portion of said tip member extends upwardly to an upper opening of said socket portion through which said shaft member of said cane extends into said tip member, said upper opening of said socket portion having a diameter which is sized larger than a diameter of said shaft member where said shaft member passes therethrough, so as to permit said shaft member to tilt through a predetermined angular range of motion relative to said tip member before coming into contact with said wall portion at said upper opening of said socket portion.

20. A walking cane having a pivoting tip assembly, comprising:

a shaft member having a long axis and upper and lower ends;

a tip member having a socket portion in which said lower end of said shaft member is received and a base portion for resting on an underlying support surface, said socket portion of said tip member comprising:

(i) a generally cylindrical wall portion, said wall portion being formed of a resiliently yielding material and having an interior which extends upwardly to an upper opening through which said shaft member of said cane extends into said tip member, said upper opening having a diameter which is sized larger than a diameter of said shaft member where said shaft member passes therethrough, so as to permit said shaft member to tilt through a predetermined angular range of motion relative to said tip member before coming into contact with said wall portion at said opening, an upper edge of said wall portion being configured to resiliently arrest tilting motion of said shaft member as said shaft member comes into contact therewith at a limit of a predetermined angular range of motion between said tip member and said shaft member; and (ii) an interior floor portion having a generally flat upper surface which overlies said base portion of said tip member; and a disk member interconnecting said shaft member and said tip member, said disk member comprising (a) a center portion which is mounted to said lower end of said shaft member by a pivot connection so as to permit said disk member to rotate freely about said long axis of said shaft member, so that said base portion of said tip member remains in stationary engagement with said underlying support surface as said shaft member of said cane is twisted back and forth, said pivot connection comprising:

(i) a plug portion on said lower end of said shaft member; and (ii) a screw member which extends upwardly through said center portion of said disk member into said plug portion generally coaxially with said long axis of said shaft member, so that a shank portion of said screw member forms a pivot axis for rotation of said disk member and a head portion of said screw member secures said disk member to said lower end of said shaft member; and (b) an outer edge portion which is in sliding engagement with an interior surface of said socket portion of said tip member and a bottom portion which tilts on said floor portion of said tip member so as to permit said disk member to tilt freely within said socket portion, so that said base portion of said socket member remains in stationary engagement with said underlying support surface as said shaft member of said cane is tilted from side to side, (i) said outer edge portion of said disk member having a generally circular rim portion which is in substantially continuous engagement with said interior surface all around said cylindrical wall portion of said socket portion, and (ii) said bottom portion of said disk member having a downwardly curved lower surface which forms a rocker bearing surface against said flat upper surface of said floor portion of said socket member, so as to facilitate tilting of said disk member on said floor portion in response to side-to-side tilting of said shaft member.

* * * * *